United States Patent [19]

Phillips

[11] Patent Number: 4,577,901

[45] Date of Patent: Mar. 25, 1986

[54] CONVERTIBLE UTILITY CHAIR

[76] Inventor: Mark R. Phillips, 65 Montsalas Dr., Monterey, Calif. 93940

[21] Appl. No.: 729,120

[22] Filed: Apr. 30, 1985

[51] Int. Cl.[4] ..... A47C 4/00

[52] U.S. Cl. ..... 297/17; 297/48; 224/155

[58] Field of Search ..... 297/17, 31, 46, 48, 297/217; 224/155; 190/8

[56] References Cited

U.S. PATENT DOCUMENTS

| | | | |
|---|---|---|---|
| 2,915,154 | 12/1959 | Holder | 297/17 X |
| 2,943,672 | 7/1960 | Hook et al. | 297/31 |
| 3,179,465 | 4/1965 | Roberts | 297/17 |
| 3,309,134 | 3/1967 | Roberts | 297/17 |
| 3,450,432 | 6/1969 | Minsker | 297/17 |
| 3,662,932 | 5/1972 | Kerschner | 297/17 |
| 3,947,903 | 4/1976 | Menke | 297/17 |
| 4,487,345 | 12/1984 | Pierce et al. | 297/17 X |

*Primary Examiner*—Francis K. Zugel

*Attorney, Agent, or Firm*—Elliott N. Kramsky

[57] ABSTRACT

A convertible utility chair includes a frame structure comprising a number of frame elements of preselected shapes for providing, when folded, a compact, transportable carry-all including ample open volume for storage purposes. Frame elements are joined to one another by rivets and subassemblies that allow the conversion from chair to carry-all configuration by a simple application of manual pressure.

6 Claims, 10 Drawing Figures

CONVERTIBLE UTILITY CHAIR

BACKGROUND

1. Field of the Invention

The present invention relates to transportable utility chairs particularly useful for the beach and other recreational uses. More particularly, the present invention pertains to a utility chair that, when folded, is also useful as a carry-all.

2. Description of the Prior Art

Utility chairs for beach or other recreational use are well known in the art. The need to transport such chairs by hand has led to recurrent attempts to attain new and useful alternative, folded structures having independent utility. A favored alternate configuration has been that of a baggage carry-all-and-chair. Examples of such prior art convertible chairs are shown in U.S. Pat. Ser. Nos. 3,309,134 of Roberts for "Interchangeable Luggage-Chair Structure," 2,398,478 of Valenti for "Combination Valise and Chair," 3,947,903 of Menke for "Folding Couch for Beach or Camping," 3,662,932 of Kerschner for "Pack Convertible to Stool," and 2,915,154 of Holder for "Combination Seat and Carrying Bag."

The convertible chair-baggage carry-all combinations of the prior art have generally been characterised by complexity of structure and/or application and inadequacy of essential features.

SUMMARY OF THE INVENTION

The present invention overcomes the foregoing and additional shortcomings of the prior art by providing an improved chair that is convertible into a carry-all. The convertible chair includes a substantially U-shaped back frame. A back panel is supported by the back frame. A seat frame is provided of substantially U-shape that includes portions spaced from its U-shaped portion to define armrests. A seat panel and arm panels are supported by the seat frame.

A generally U-shaped front leg base frame is provided and such frame is pivotally joined to the back frame. Finally, a generally U-shaped rear leg base frame is provided, such frame being pivotally joined to the back frame.

The preceding and additional features and advantages of the invention will become further apparent from the detailed description that follows. This description is accompanied by a set of drawing figures. Numerals of the drawings, corresponding to like designations of the detailed description, are provided for guidance, like numerals corresponding to like features of the invention throughout.

DETAILED DESCRIPTION

Figure 1:
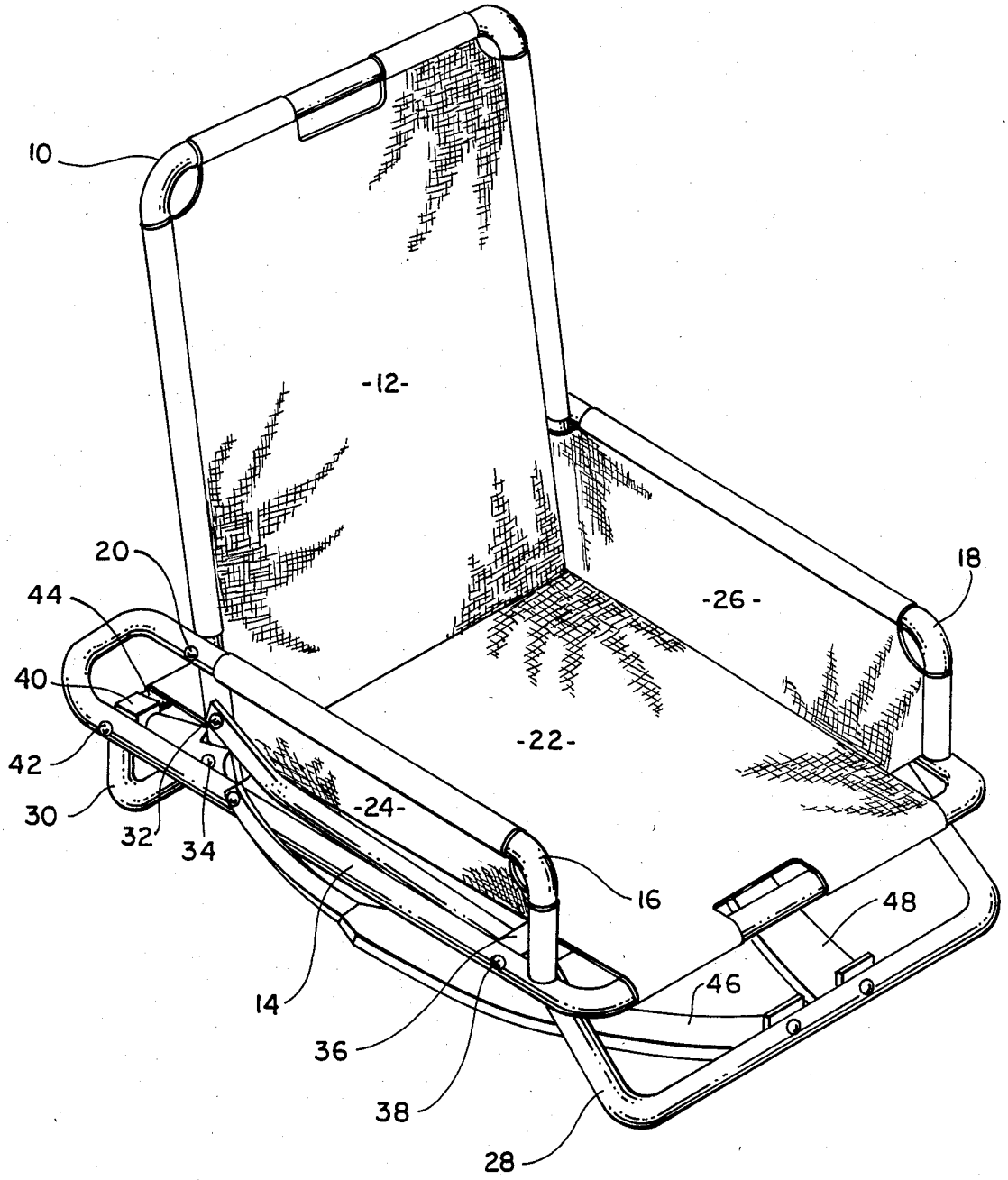
FIG. 1 is a perspective view of the convertible utility chair of the invention in its unfolded chair structure.

Turning now to the drawings, FIG. 1 is a perspective view of the convertible utility chair of the invention in its unfolded or "chair" arrangement. As is readily apparent, the invention provides a stable seat for a user in the illustrated configuration.

The chair comprises a unique collapsible frame to which fabric or fabric-like backing is preferentially attached. The backing enhances the utility of the invention in both its unfolded chair form and in its folded "carry-all" or "backpack" structure. The frame, comprising a unique arrangement of tubular members and other subassemblies, permits the ready conversion of the invention from one of the above-referenced forms to the other without sacrificing either the structural integrity or serviceability of the end configuration.

Referring now to the chair of FIG. 1 in detail, it is seen to include a tubular back frame 10 of generally U-shape. The back frame 10 and all other tubular frame members may be of either moldable metal or synthetic composition including, for example, aluminmum or extruded steel tubing.

A back panel 12 of either synthetic or cloth fabric is fixed to the back frame 10. Any of a number of conventional means may be employed to affix the back panel 12, and the other fabric panels, to the relevant frame members, including sewing, gluing, stapling and the like. Further, while the panels are shown to comprise integral shapes, the invention is equally adaptable to panels that are formed of non-continuous structures including, but not limited to a plurality of criss-crossing fabric strips.

A tubular seat frame 14, including armrest portions 16, 18 integral therewith, is pivotally engaged to the back frame 10. As is shown in FIG. 1, a rivet 20 and a corresponding rivet (not visible in this figure) define the pivot axis between the back frame 10 and the seat frame 14. Seat panel 22 is fastened to the front portion of the U-shaped seat frame and side panels 24, 26 are affixed to armrest portions 16 and 18 respectively in like manner to that in which the back panel 22 is fixed to the tubular back frame 10. All panels are joined by sewing, gluing, stapling or like conventional means at the indicated mutual seams.

While the back frame 10 is joined to the seat frame 14 at the armrest portions 16, 18 thereof to define an axis of rotation at a point somewhat intermediate the length of the side(s) of the back frame 10, the back frame 10 is further pivotally engaged to a front leg base frame 28 and to a back leg base frame 30 near the bottom ends of its sides.

Each of the leg base frames 28, 30 is a generally U-shaped, out-of-plane form defining, at its central portion, a member for contacting a planar surface. Angularly sloped portions define the "legs" of the unfolded chair structure of FIG. 1.

A rivet 32 and a correspondingly-situated rivet (not shown in the view) fix the axis of rotation of the front leg base frame 28 relative to the back frame 10 while a rivet 34 and correspondingly-situated rivet (not visible in FIG. 1) define the axis of rotation of the back leg base frame 30 relative to the back frame. As will become apparent from the discussion of the operation of the folding mechanism of the invention that follows, the relative shapes and locations of the axes of rotation between the above-referenfed frame members reflect important design factors for accomplishing the goals and advantages of the present invention.

Means are provided for securing the leg base frames 28, 30 to the seat frame 14 so that slidable relationships are provided therebetween. Front subassembly 36 (and a correspondingly situated opposed subassembly, not visible in the figure), pivotally secured by means of a rivet 38, provides pivotal and slidable degrees of freedom between the front leg base frame 28 and the tubular seat frame 14 while rear subassembly 40, secured by the rivet 42 (and a similar arrangement, not visible in the figure) allows similar movement between the seat frame 14 and the back leg base frame 30. It should be noted that, in the unfolded chair configuration of FIG. 1, the rear subassemblies are positioned proximate to the bent portions of the back leg base frame 30. The detailed arrangements comprising the front and rear subassemblies, which facilitate important required functions in the folding operation of the invention are disclosed in FIGS. 3(*a*) and 3(*b*) which follow.

A substantially straight rear support bar 44 adds rigidity to the chair structure. The bar 44 is fitted at its opposed ends to the rear subassemblies that secure the seat frame 14 to the back leg base frame 30. A pair of straps, 46, 48 can be seen beneath the seat panel 22. The straps, fixed to the front leg base frame 28 and to the seat frame 14, are arranged to form a harness, seen more clearly in the next figure, for transporting the apparatus of the invention in its alternate, folded configuration.

Figure 2B:
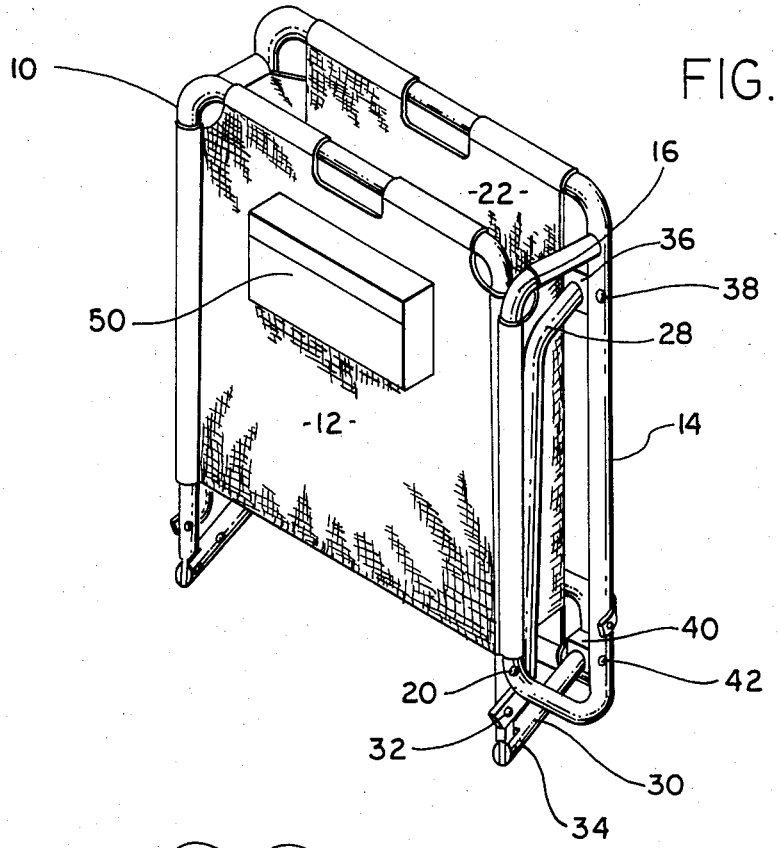
FIGS. 2(*a*) and 2(*b*) are perspective views of the convertible utility chair of the invention in its folded backpack or carry-all configuration from opposed perspectives.
Figure 2A:
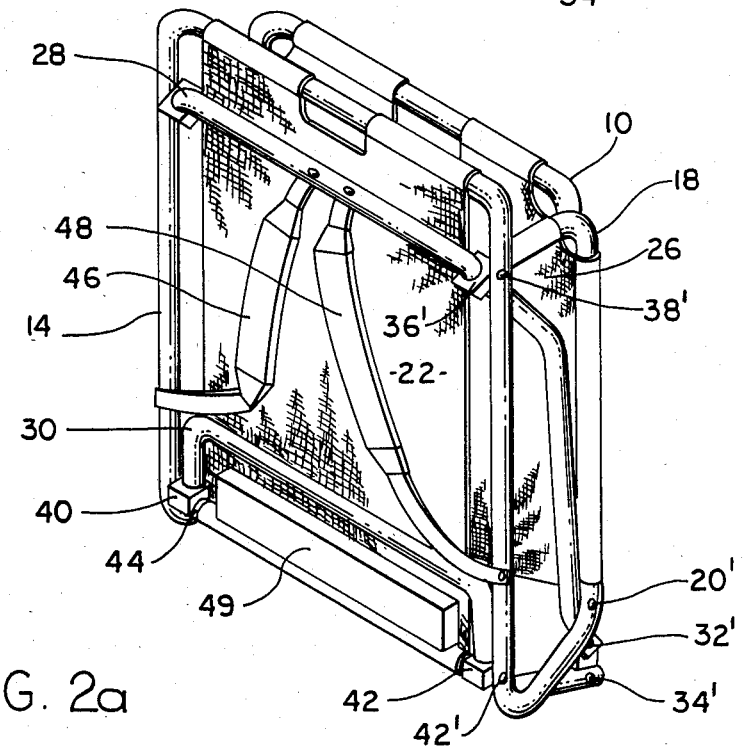

FIGS. 2(*a*) and 2(*b*) illustrate the convertible utility chair of the present invention in its alternative preselected form. The two figures disclose the folded arrangement from opposed perspectives, permitting an overall appreciation of the features of this configuration. By comparing the numbering of the elements comprising the folded structure with those of the unfolded chair structure of FIG. 1, one may readily appreciate the compactness achieved by a structure that also forms a very stable and convenient apparatus for sitting on the beach or elsewhere.

FIG. 2(*a*) provides a clear view of the harness arrangement comprising the straps 46 and 48. This harness provides a convenient means for transporting the invention, either in the manner of a backpack or by grasping the straps, singly or as a pair. A pad 49, fixed to the underside of the seat panel 22, acts as a cushion, protecting the back of the person carrying the chair from discomfort due to the tubular back leg base frame 30 and rear support bar 44. In FIG. 2(*b*) one can see that a pouch 50 is fixed to the back panel 12, further enhancing the utility of the invention in its folded, transport carry-all configuration. The pouch might accommodate any of a number of items, such as fishing gear, food or the like.

The view of FIGS. 2(*a*) and 2(*b*) disclose that, unlike conventional folding chairs, the folded form of the invention affords a substantial volume 52, open at the top, for storing and transporting numerous bulky items, such as towels, beverages, magazines and the like. As can be seen, the depth of the volume 52 is provided by the location of the pivot points that secure the various frame members, most particularly, the seat frame 14, back frame 10 and leg base frames 28, 30. The fabric panels complete the enclosure of the volume 52.

While the advantages of the invention, in both its unfolded and folded configurations are apparent, a substantial aspect of the invention pertains to the manner in which means are provided for folding and unfolding the apparatus to attain and lock the somewhat involved arrangements that characterize these two states. Before discussing the operation of the invention, however, it will be helpful to disclose in greater detail the arrangements comprising the rear and front subassemblies 36, 40 that facilitate the relative motions required of the frame apparatus of the invention.

Figure 3A:
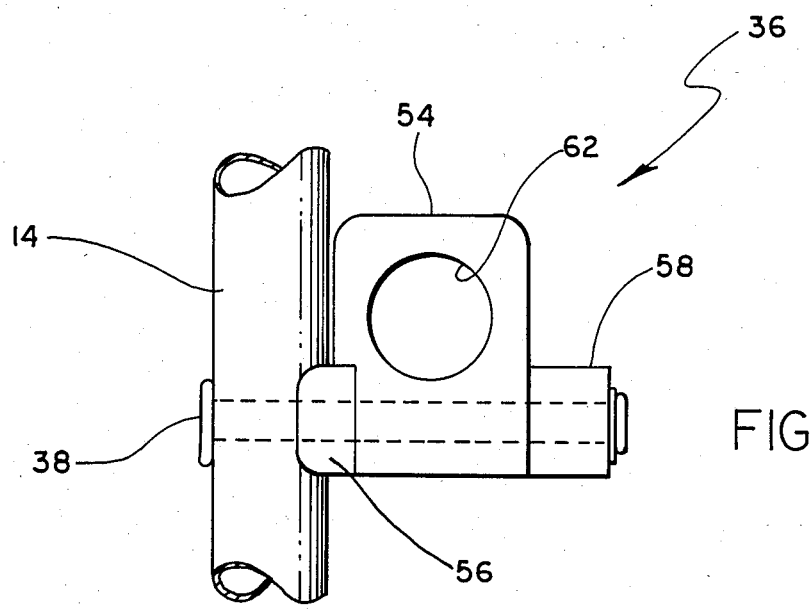
FIGS. 3(*a*) and 3(*b*) are top and front views, respectively, of the subassemblies employed in the present invention.
Figure 3B:
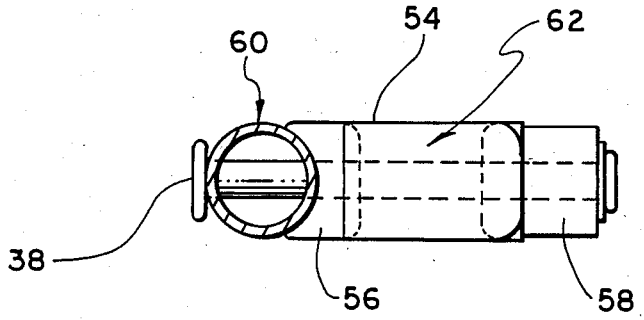
Figure 4A:
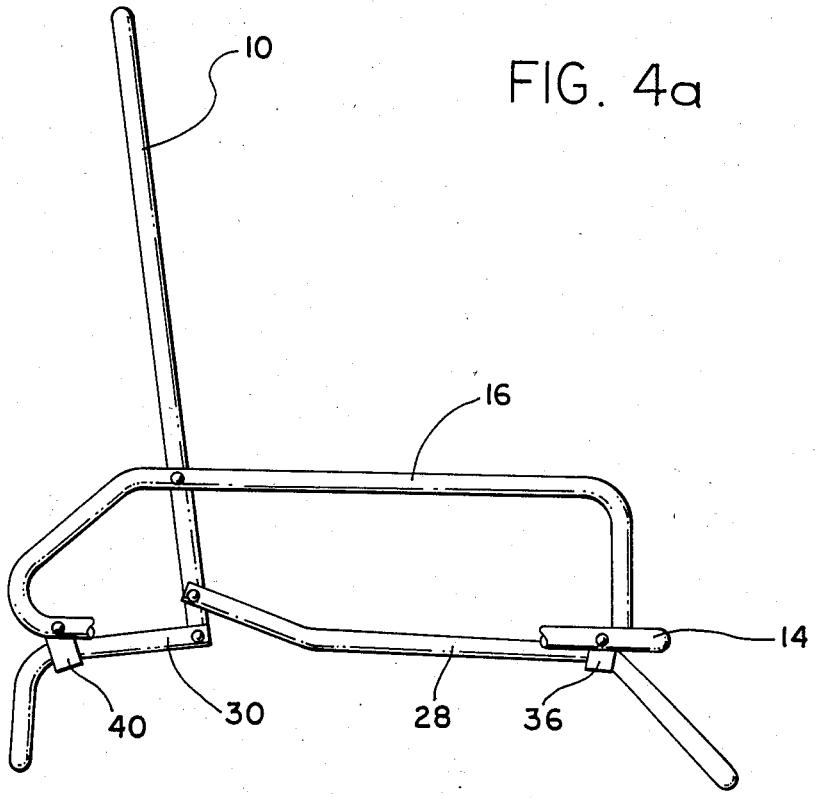
FIGS. 4(*a*) through 4(*e*) disclose a series of partial side views, including partially broken frame members, that illustrate the sequential conversion operation of the invention from a chair to a carry-all configuration.
Figure 4B:
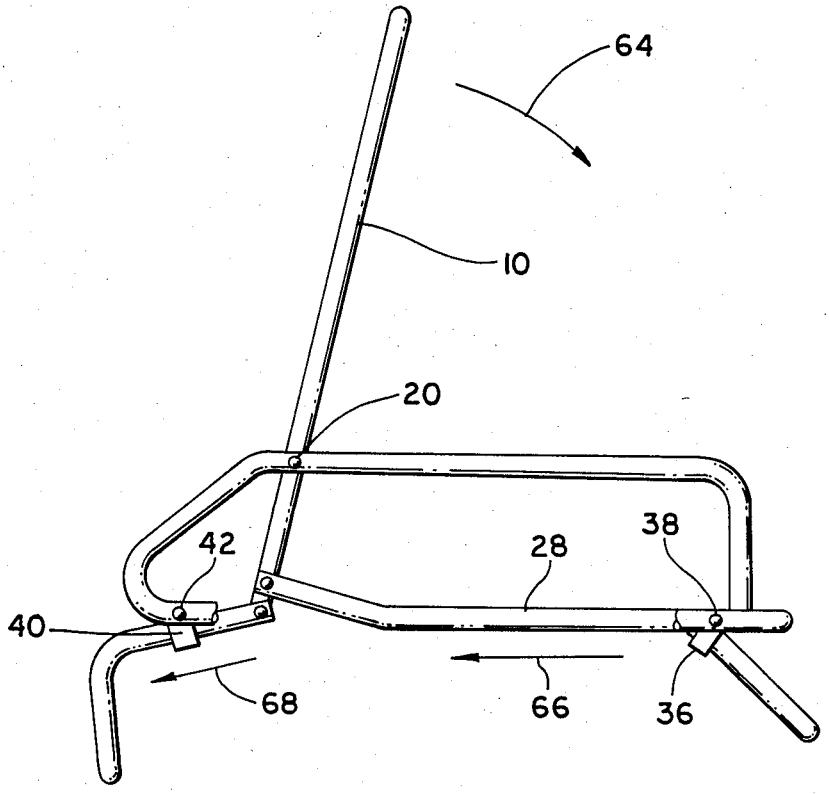
Figure 4C:
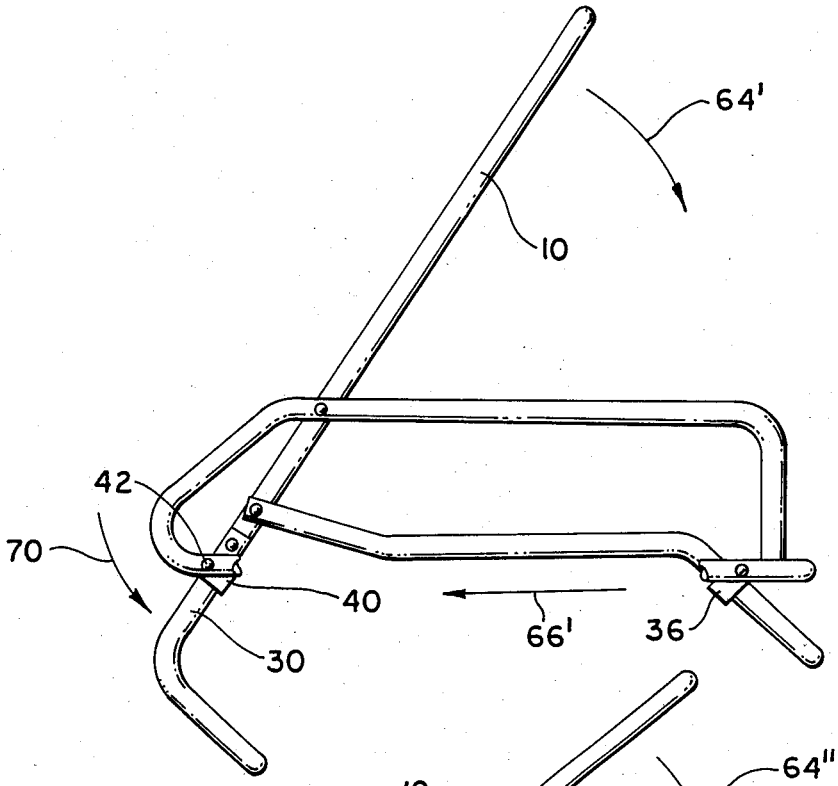
Figure 4D:
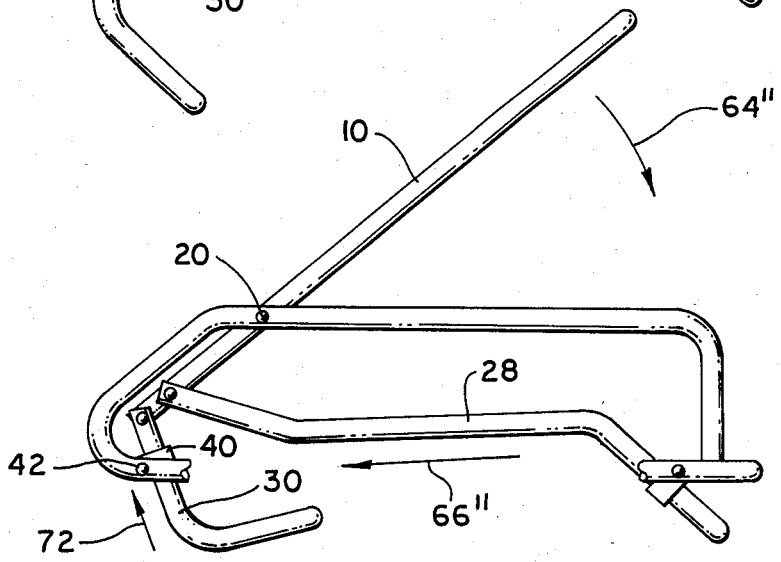
Figure 4E:
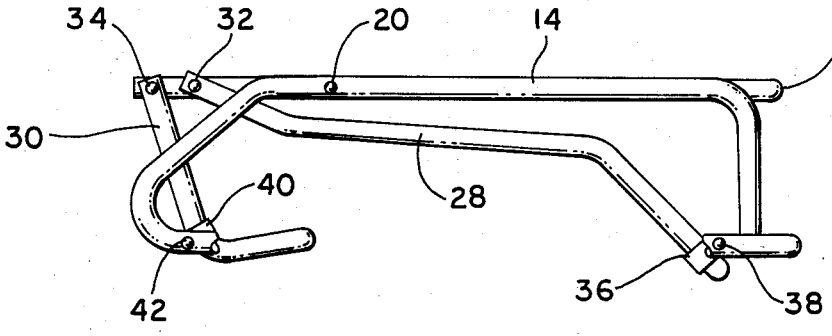

FIGS. 3(*a*) and 3(*b*) are top and front detailed views, respectively, of the subassembly arrangements utilized in the invention. Four of such arrangements are employed, two front subassemblies joining the tubular seat frame 14 to the front leg base frame 28 and two rear subassemblies joining the seat frame 14 to the back leg base frame 30. These subassemblies provide a combination of rotational and translational movement guided by the geometry of the frame member passing therethrough.

Both subassemblies are pivotally joined to the tubular seat frame 14 and slidably joined to a corresponding leg base frame. Thus, turning to FIG. 3(*a*), which presents a detailed view of the front subassembly 36, one can see that the semitubular rivet 38 secures an overall rotatable arrangement to the frame 14 that includes a subassembly body 54, a pivot pad 56 and a bolt 58. The height of the bolt 58 differs from the front assemblies to the rear subassemblies, a somewhat greater height being employed with the rear subassemblies to accommodate the interior of and to secure the opposed ends of the rear support bar 44. A corresponding support bar is not anchored by the front subassemblies.

Both the pivot pad 56 and the subassembly body 54 may comprise polyethylene members formed, for example, by injection molding processes. As is seen most clearly in FIG. 3(*a*), the pivot pad 36 provides a small clearance between the seat frame 14 and the subassembly body 54 to facilitate ease of rotation therebetween. A concave surface 60 of the pad 56 mates with the tubular surface of the frame 14, effectively restraining rotation of the pivot pad with respect to the frame.

A circular interior aperture 62 in the subassembly body 54 is adapted to receive and to allow travel of a tubular leg assembly therethrough. The aperture 62 is located eccentrically with respect to the axis of rotation of the body 54 about the rivet 38. In the instance of the front subassembly illustrated in FIG. 3(*a*), the aperture is adapted to accommodate the exterior tubular shape of the front leg base frame 28. Thus, it is seen that the subassemblies permit both longitudinal movement (due to the aperture) and rotational movement (due to the eccentric mounting of the aperture) of the front and back leg base frames 28, 30 with respect to the seat frame 14.

As the various mechanisms and geometries comprising the convertible utility chair of the invention have now been set forth, the operation of the invention, insofar as the manner in which its conversion from an open chair configuration to a closed backpack or carry-all configuration is accomplished will now be explained with reference to the sequence illustrated in FIGS. 4(*a*) through 4(*e*). These figures illustrate the progression of events that take place as the utility chair is folded. Certain elements of the invention have been removed and others shown in partial, broken view to facilitate access to the pertinent mechanisms.

Turning now to FIG. 4(*a*), one can see a side view of the unfolded chair as shown in FIG. 1. Numerals corresponding to those employed as reference numerals in the preceding figures make reference to the pertinent frame members, pivot points (i.e. rivets) and subassemblies.

FIG. 4(*b*) indicates the geometry of the invention after the initial application of pressure against the back frame 10, resulting in the indicated clockwise rotation 64 of the back frame 10. Concurrent with the rotation of the back frame 10, the front leg base frame 28 is pulled to the left (direction arrow 66) and the back leg base frame is pushed to the left and downward (direction arrow 68) under the leverage exerted by the lower portion of the back frame 10 pivoted about the rivet 20. The front subassembly 36 is rotated somewhat in a clockwise direction but the rivet 38 and the rear subassembly 40 is rotated somewhat counterclockwise about the rivet 42 to accomplish the changes in the shapes of those portions of the respective leg base frames now passing through the apertures in the subassemblies.

The rotation of the back frame 10 in a clockwise direction 64 is continued in FIG. 4(*c*). As before, the leverage exerted by the back frame 10 continues to pull the front leg base frame leftward through the aperture in the front subassembly 36. The back frame 10 is now in alignment with the upper portion of the rear leg base frame 30. As the two elements come into alignment, the rear subassembly 40 has continued to rotate in a counterclockwise direction 70 about the rivet 42.

In FIG. 4(*d*) one can see that, after the point of alignment of the back frame 10 with the upper portion of the rear leg base frame 30 reached in FIG. 4(*c*), the rear leg base frame 30 is now pulled through the aperture in the rear subassembly 40 in the direction 72, reversing its previous travel therethrough, by the leverage of the rotation of the back frame 10 about the rivet 20. The rear subassembly 40 has continued to rotate in a counterclockwise direction about the rivet 42 and the front leg base frame 28 is pulled further to the left by the back frame 10.

The clockwise rotation of the back frame 10 is continued until the apparatus is folded into the closed position shown in FIGS. 2(*a*) and 2(*b*). A side view of this position is shown in FIG. 4(*e*). By a comparison with the geometry of the prior figure, one can see that the rear leg base frame 30 continues to be pulled through the rear subassembly 40 until, in its folded position, the rear subassembly 40 is positioned approximately the same position (at the bend in the rear leg base frame 30) as in the chair position of FIG. 4(*a*), although rotated about 120 to 150 degrees therefrom in a counterclockwise direction.

The rear subassembly 40 locks the folded carry-all configuration in its indicated orientation. (The folding sequence of FIGS. 4(*a*) through 4(*e*) is reversed when unfolding to the chair configuration.) The front leg base frame 28 is taken upward through the aperture in the front subassembly 36 until only a small portion extends beyond that subassembly. The shape of the rear leg base frame cooperates with the overall geometry of the carry-all, its "leg" portion extending substantially parallel to the folded back frame 10 in the position illustrated in FIG. 4(*e*). The armrest portion 16 of the seat frame 14, in conjunction with the upper portion of the rear leg base frame 30, defines the depth of the folded configuration that provides the advantageous interior volume 52 of the carry-all. Additionally, the bend in the rear leg base frame 30 is approximately aligned with the folded point of rotation joining the back frame 10 to the rear leg base frame 30. Referring back to FIGS. 2(*a*) and 2(*b*), this alignment is seen to permit the user to stand the apparatus of the invention in its folded position whereby articles stored in the volume 52 will not fall out, a further advantageous feature of the present invention.

Thus it is seen that there has been brought to the art improved collapsible recreation apparatus. The convertible utility chair of the invention provides a highly stable seat for the beach or another environment possessing many desirable features. The chair elevates the user off the ground, greatly enhancing the variety of environments in which it may be advantageously employed. In its folded position, the chair converts into a highly useful carry-all allowing one to transport many essential items without added encumbrance.

While this invention has been described with reference to a presently preferred embodiment, its extent is not intended to be so limited. Rather, the full extent of the invention is to be gained with reference to the invention as defined in the set of claims that follows and extends to all equivalents thereof.

What is claimed is:

1. A chair that is convertible into a carry-all comprising, in combination:

(a) a tubular, substantially U-shaped back frame;

(b) a back panel, said panel being supported by said back frame;

(c) a tubular seat frame having a substantially U-shape and including portions spaced from said generally U-shape defining armrests, said last-named frame being pivotally jointed to said back frame;

(d) a seat panel, said panel being supported by said seat frame;

(e) arm panels, said panels being supported by said seat frame;

(f) a tubular front leg base frame having a generally U-shape, said last-named frame being pivotally joined to said back frame; and (g) a tubular rear leg base frame having a generally U-shape, said last-named frame being pivotally joined to said back frame.

2. A chair as defined in claim 1 further characterized in that:

(a) said rear leg base frame is pivotally and slidably mounted with respect to said seat frame; and (b) said front leg base frame is pivotally and slidably mounted with respect to said seat frame.

3. A chair as defined in claim 2 further characterized in that:

(a) said generally U-shaped tubular front leg base frame includes two sides, each of two substantially straight portions joined at a bend; and (b) said generally U-shaped tubular rear leg base frame includes two sides, each of two substantially straight portions joined at a bend.

4. A chair as defined in claim 3 wherein said back frame is pivotally joined to said seat frame at the armrest portions of said seat frame.

5. A chair as defined in claim 4 further characterized in that:

(a) said front leg base frame is pivotally joined to said back frame at a point beneath that at which said armrests are pivotally joined to said back frame; and (b) said rear leg base frame is pivotally joined to said back frame at a point beneath that at which said front leg base frame is joined to said back frame.

6. A chair as defined in claim 5 further including a harness for carrying said chair.

* * * * *